United States Patent [19]

Deans

[11] 3,990,298

[45] Nov. 9, 1976

[54] METHOD OF DETERMINING THE RELATION BETWEEN FRACTIONAL FLOW AND SATURATION OF OIL

[75] Inventor: Harry A. Deans, Houston, Tex.

[73] Assignee: Exxon Production Research Company, Houston, Tex.

[22] Filed: Nov. 17, 1975

[21] Appl. No.: 632,414

[52] U.S. Cl. ..... 73/155; 166/252

[51] Int. Cl.[2] ..... E21B 47/00

[58] Field of Search ..... 73/155, 151; 166/252, 166/250

[56] References Cited

UNITED STATES PATENTS

| | | | |
|---|---|---|---|
| 3,590,923 | 7/1971 | Cooke | 166/252 |
| 3,623,842 | 11/1971 | Deans | 166/252 |
| 3,847,548 | 11/1974 | Keller | 166/252 |
| 3,856,468 | 12/1974 | Keller | 166/252 |

*Primary Examiner*—James J. Gill
*Assistant Examiner*—Anthony V. Ciarlante
*Attorney, Agent, or Firm*—Gary D. Lawson

[57] ABSTRACT

Disclosed herein is a method for determining the fractional flow and corresponding fluid saturation of fluid phases in a subterranean oil-bearing formation containing more than one mobile fluid phase. A carrier fluid containing a plurality of precursors is injected into the formation by means of a well. The carrier fluid is substantially insoluble in a first fluid phase and miscible with a second fluid phase in the formation. Each of the precursors has a distinct partition coefficient between the carrier fluid and the first fluid phase which differs from the partition coefficients of the other precursors. Each precursor forms at least one tracer product within the formation with each tracer having a partition coefficient between the carrier fluid and the first fluid phase which differs from that of its corresponding precursor. After measurable quantities of tracer are formed by the precursors, the carrier fluid tracer solution is displaced through the formation to a point of detection which is preferably the injection well. The relation between fractional flow and saturation of the fluids in the formation can be determined by applying the principles of chromatography as applied to the movement of the precursors through a porous medium containingtwo mobile fluid phases.

16 Claims, 2 Drawing Figures

METHOD OF DETERMINING THE RELATION BETWEEN FRACTIONAL FLOW AND SATURATION OF OIL

BACKGROUND OF THE INVENTION

1. Field of the Invention

This invention relates to a process utilizing a well or wells and includes the steps of testing or measuring formation fluids. More specifically, this invention relates to a method for determining the fractional flow and corresponding saturation of fluid phases in a subterranean reservoir being flooded by a fluid.

2. Description of the Prior Art

A typical oil productive formation is a stratum of rock containing tiny, interconnected pore spaces which are saturated with oil, water, and gas. Knowledge of the relative amounts of these fluids in the formation and the flow properties of the formation is indispensable to proper and efficient production of formation oil. For example, when a formation is first drilled it is necessary to know the original oil saturation to intelligently plan the future exploitation of the field. The quantity of oil present in the formation will often dictate the most efficient manner of conducting tertiary recovery operations, such as solvent flooding. The concentration of oil in the formation may indicate which of the several alternative tertiary recovery techniques might best be employed to produce the oil. In waterflooding operations, the relation between fractional flow and fluid saturations in the formation is required to provide an estimate of the oil recovery that might be obtained by flushing the formation with water.

There are several methods which are currently used to obtain the fluid saturations and flow properties of a formation. Coring, the most commonly used technique for acquiring this information, is a direct sampling of the formation rock and fluids. For example, a small segment of the formation rock saturated with fluid is cored from the formation and removed to the surface where its fluid content and permeability can be analyzed. This method, however, is susceptible to a fault common to any sampling technique; the sample taken may or may not be representative of the formation as a whole. Also, there is a genuine possibility that the coring process may change the fluid saturation or permeability of the extracted core. Moreover, coring can only be employed in newly drilled wells or open hole completions. In the vast majority of wells, casing is set through the oil-bearing formation when the well is initially completed. Core samples, therefore, cannot subsequently be obtained from such a well. Finally, coring by its very nature investigates only the properties of the formation rock and fluids in the immediate vicinity of the wellbore.

Another approach to obtaining reservoir fluid saturations and flow properties is by logging techniques. These techniques also investigate the formation rock and fluid properties for only a very short distance beyond the wellbore. These techniques study a rock-fluid system as an entity; it is often difficult by this approach to differentiate between the properties of the rock and its fluids.

Material balance calculations based on production history are another approach to the problem. Estimates of the fluid saturation acquired by this method are subject to even more variables than coring or logging. This technique requires a knowledge of the initial fluid saturation of the formation by some other method and knowledge of the source of recovered fluids.

More recent methods for determining fluid saturations in a subterranean formation are concerned with injection and production of trace chemicals into and out of the formation. In one method, a carrier fluid containing at least two tracers having different partition coefficients between the immobile fluid phase of the formation and the carrier fluid in which the tracers are contained is injected into one location in the formation and produced from another. Due to the different partition coefficients of the tracers, they will be chromatographically separated as they pass through the formation, and this chromatographic separation is a function of the saturation of the immobile phase. In another method a carrier fluid containing a reactive chemical substance is injected into the formation through a well. The carrier fluid-reactant solution is displaced into the formation and the well is shut-in to permit the reactant to undergo a chemical change to produce additional tracer materials having different partition coefficients. When the well is produced, the reactant tracers having differing partition coefficients are chromatographically separated, and the degree of separation is a function of the saturation of the immobile fluid phase. In still another method, a carrier fluid containing tracers is injected into the formation and permitted to move within the formation under the influence of fluid drift. There is a chromatographic separation of the tracers during the movement of the carrier fluid due to fluid drift. The carrier fluid is then produced, and the chromatographic separation is measured to determine fluid saturations of the immobile fluid phase.

While these more recent methods have applicability in determining fluid saturation in a subterranean formation, they are designed primarily for use in those formations containing essentially one mobile fluid phase. A principal problem with these methods is that the measured results can be extremely difficult to analyze if two mobile fluid phases are present.

SUMMARY OF THE INVENTION

In accordance with the teachings of one embodiment of this invention, the fractional flow of each of two mobile fluid phases and corresponding fluid saturations in a hydrocarbon-bearing formation containing two mobile fluid phases are determined by injecting into the formation a carrier fluid containing a plurality of chemical substances, each of these substances being a precursor. The carrier fluid is substantially insoluble in a first fluid phase, and soluble with a second fluid phase. Each of the precursors has a distinct partition coefficient between the carrier fluid and the first fluid phase which differs from the partition coefficient of the other precursors. Because of this difference in partition coefficients, the precursors travel through the formation at different velocities during the injection cycle. After the carrier fluid-precursor solution has been injected into the formation, the well is shut-in. During this "soak period" at least a part of each precursor reacts to form a tracer product having a partition coefficient between the first mobile fluid phase and carrier fluid which differs from that of its corresponding precursor. After the soak period the well is returned to production and the produced fluids are analyzed for the presence of tracers. The fractional flow and corresponding saturation of the first fluid phase in the formation is determined by using principles of chromatography as applied to the flow of two mobile fluid phases through a porous medium.

In another embodiment of this invention a carrier fluid containing a plurality of chemical substances is injected into a subterranean formation containing two mobile fluid phases. The carrier fluid is substantially insoluble in a first fluid phase and soluble with a second fluid phase. Each of the chemical substances has a distinct partition coefficient between the carrier fluid and the first fluid phase which differs from the partition coefficient of the other chemical substances. Because of this partition coefficient difference, the chemical substances traverse the formation at different velocities. The chemical substances are detected at a point of detection, preferably at a producing well. The fractional flow and corresponding saturation of the first fluid phase in the formation are determined by using principles of chromatography as applied to the flow of two mobile fluid phases through a porous medium.

Objects and features of the invention not apparent from the above discussion will become apparent upon consideration of the following description of the invention taken in connection with the accompanying drawings.

DESCRIPTION OF THE PREFERRED EMBODIMENT

For the sake of clarity it may be helpful to define some of the symbols that will be used herein to describe physical properties measured in the practice of this invention. The symbol S is used to refer to that portion of the pore space in a porous medium which is occupied by a particular fluid and the symbol f refers to that portion of the total fluid flow in the porous medium which is the particular fluid.

Figure 1:
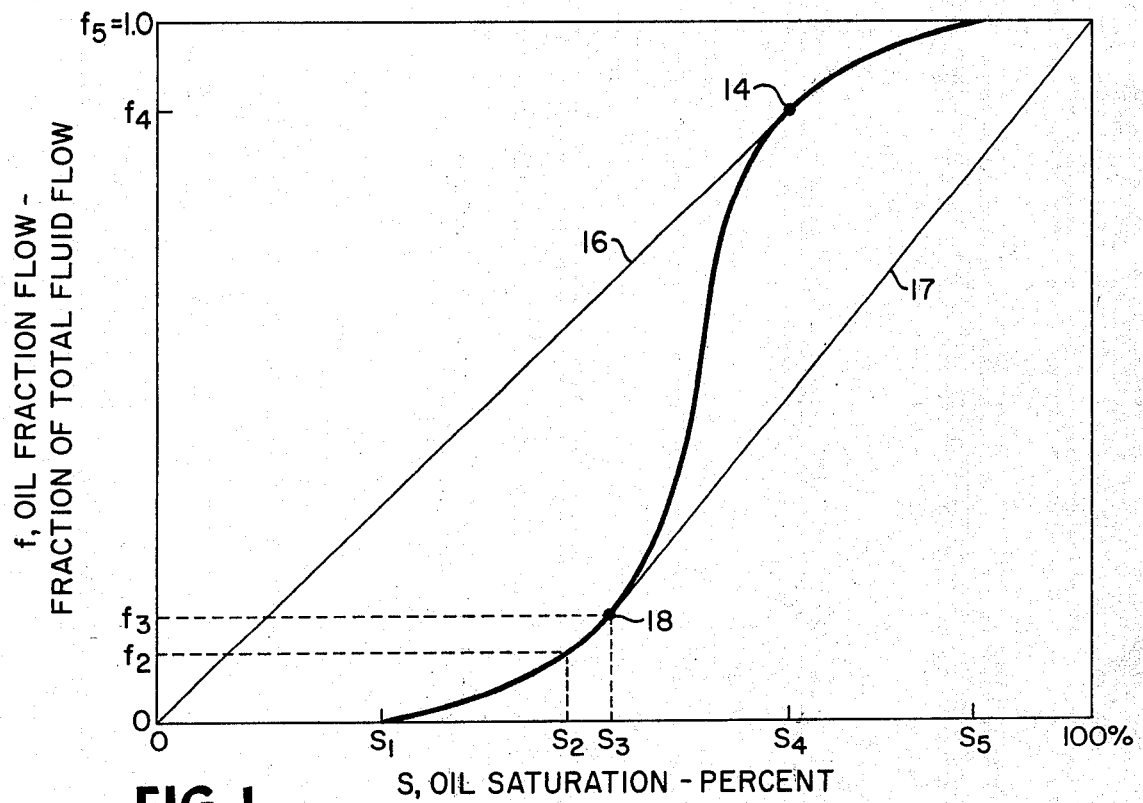
FIG. 1 is a plot of fractional flow of oil as a function of oil saturation.

FIG. 1 is a graph of the oil fractional flow, $f$, as a function of oil saturation, S, in a typical oil-bearing formation. When a well is first drilled, the initial oil saturation in the formation is $S_5$ and the corresponding fractional flow is $f_5$. The readiness with which oil flows through a formation decreases as the oil saturation in the formation decreases. The relation between $f$ and S is dependent on a number of variables, including the relative permeability of formations to oil and water and the viscosity of the formation oil and water. For this reason the relation between $f$ and S may vary from one formation to another. For example, in some formations residual oil saturation, $S_1$, may be much lower than the residual oil saturation obtainable in another formation. Also, it may be more difficult in some formations to reduce S to residual conditions by waterflooding than in other reservoirs. It is, therefore, desirable to measure the fractional flow of oil as a function of oil saturation, particularly near residual oil saturation. Such information can be very valuable in determining the most efficient process to use for recovering crude oil from a formation.

The description which follows typifies one specific embodiment for measuring $f$ as a function of S in an oil-bearing formation containing both mobile oil and water. This embodiment can also measure the saturation of oil in a formation at connate water saturation. The use of this method for other purposes will be readily apparent from this description.

A subterranean formation lying below the surface of the earth is penetrated by a well which has been drilled from the surface and provides fluid communication between the interior of the well and the formation. The formation has an average thickness of 20 feet and an average porosity of approximately 25%. The formation water has a pH of approximately 7 and the formation temperature is approximately 160° F. For the purpose of this illustration it is assumed that prior to injection of the carrier fluid the formation contains both mobile crude oil and mobile water.

A carrier fluid is prepared at the surface which contains a plurality of chemical substances referred to herein as precursors. These precursors are soluble in the carrier fluid and have varying solubilities in crude oil. Brine previously produced from the formation is used as a carrier fluid. In this example, the carrier fluid and resident formation water are soluble with each other. The precursors, methyl acetate, ethyl acetate, propyl acetate, and butyl acetate, are each added to the brine at a concentration of one-half percent by volume. These precursors have a partition coefficient of 1.5, 5, 8, and 16, respectively, between the carrier fluid and oil. The partition coefficient, K, is defined as a mass of a substance per unit volume of oil divided by the mass of the substance per unit volume of carrier fluid in equilibrium at reservoir conditions. One hundred barrels of carrier fluid/precursor solution are injected into the formation at a rate of 850 barrels per day. The carrier fluid/precursor solution is displaced into the formation by injecting an additional 1350 barrels of brine at the same rate. Injection continues until the total volume of 1450 barrels have been displaced into the reservoir.

After the carrier fluid with the reactants has been displaced into the formation, injection of the displacement brine is stopped and the solution is permitted to soak for 10 days in the formation. During this soak period a portion of each precursor hydrolyzes to form at least one distinct tracer product. The tracers provided by the precursors of this example are methanol, ethanol, propanol, and butanol. These alcohols are essentially insoluble in oil and, therefore, have a partition coefficient, K, of essentially zero.

After the soak period the well is produced at a rate of 650 barrels a day and the produced fluids are analyzed for the presence of tracers. As will be described in greater detail hereinafter the movement of the precursors through the formation during the injection cycle of the invention can be related to S and $f$. One method of determining the relative movement of these precursors is to determine the areal extent of the precursors from the injection well at the end of the injection cycle. Although any means can be employed for obtaining this information, a convenient method is to have the precursors produce tracers at the end of the injection cycle, back-produce the fluid through the injection well, and measure the volume of fluid produced from the formation prior to detection of the maximal tracer concentration in the produced fluid. Also, volumes of fluid produced prior to detection of the midpoint of each tracer slug can be used in a similar manner. Such procedures for detecting the tracers are described in more detail in U.S. Pat. No. 3,623,842, Deans.

The barrels of fluid produced prior to detection of each tracer are summarized below in Table I:

TABLE I

| Precursor | Tracer | Barrels Produced |
|---|---|---|
| Methyl Acetate | Methanol | 991 |
| Ethyl Acetate | Ethanol | 623 |
| Propyl Acetate | Propanol | 465 |
| Butyl Acetate | Butanol | 252 |

The oil fractional flow and corresponding oil saturation in the formation can be determined from the results of the above method using principles of chromatography as applied to movement of the precursors through a porous medium containing two mobile fluid phases. These principles are well-known and have been extensively studied. Using these principles it has been discovered that each precursor moves through the formation at the same velocity as a unique point of constant oil saturations. The point of constant oil saturation may be considered herein as a surface which moves through the formation having a fixed oil saturation. Movement of these precursors through the formation during the injection cycle can therefore be analytically related to the movement of points of constant oil saturation. Such relationships can in turn be used to determine $f$ as a function of S.

Applying the principles of chromatography, the velocity, $v_i$, of a precursor component, i, through the formation containing two mobile fluid phases may be expressed as:

$$v_i = \frac{V}{\phi A}\left[\frac{(1.0 - f) + K_i f}{(1.0 - S) + K_i S}\right] \qquad \text{Equation 1}$$

where:

$v_i$ = velocity of a component of precursor i through the formation.

$V$ = total carrier fluid volume flow rate within the formation.

$A$ = cross sectional area in the formation traversed by the carrier fluid.

$\phi$ = porosity of the formation.

$f$ = oil fractional flow.

$S$ = oil saturation in the formation.

$K_i$ = partition coefficient for precursor $i$ between oil and water.

The flow of two mobile fluid phases in one dimension may be described by the Buckley-Leverett theory. See Buckley, S. E. and Leverett, M. C., "Mechanism of Fluid Displacements in Sand" Trans., AIME (1942) 146, 107–116. According to this theory, the velocity $v_S$ of a point of constant oil saturation can be expressed as:

$$v_S = \frac{V}{\phi A}\cdot\left(\frac{df}{dS}\right)_S \qquad \text{Equation 2}$$

where:

$v_S$ = velocity of a point of constant oil saturation S through the formation.

$V$ = the total fluid volume flow rate within the formation.

$A$ = cross-sectional area in the formation through which the mobile fluids may flow.

$\phi$ = porosity of the formation.

$f$ = oil fractional flow.

$S$ = oil saturation.

$(df/dS)_S$ = the derivitive of f with respect to S at a particular value of S.

Since each precursor moves through the formation at the same velocity as a point of constant oil saturation, it follows that Equation 2 is equal to Equation 1. That is, the following relationship must hold:

$$v_S = v_i \qquad \text{Equation 3}$$

The foregoing equations describe the movement of the precursors through the formation during an injection cycle. To measure the areal extent of the precursors at the end of the injection cycle the cumulative volume of carrier fluid produced up to appearance of each tracer is measured. This volume of carrier fluid for precursor $i$ will be referred to as $V_i$. For tracers having a partition coefficient of essentially zero the volume of produced carrier fluid $V_i$, according to Buckley-Leverett theory, may be expressed as:

$$V_i = V\cdot\left(\frac{df}{dS}\right)_{S_i}\cdot(1.0 - S_i) + Vf_i \qquad \text{Equation 4}$$

where:

$V$ = the total volume of fluid injected into the reservoir.

$f_i$ = the fractional flow of oil associated with $S_i$.

$S_i$ = the characteristic oil saturation for precursor i.

It follows from the relationships expressed in Equations 3, 4, and 5 that S and $f$ for the Example previously given can be analytically expressed as:

$$S = \frac{d\left(\frac{1-g}{K}\right)}{d\left[\frac{1+(K-1)g}{K}\right]}$$

$$f = gS - \frac{(1-S)(1-g)}{K}$$

where:

$g = V_i/V$ ($V_i$ is the volume of carrier fluid between the wellbore and the bank of precursor i at shut-in and V is the total volume of fluid injected into the reservoir. For every precursor i there will be a distinct value of g.)

$S$ = oil saturation.

$f$ = fractional flow of oil $K$ = partition coefficient of the precursor between oil and water.

These relationships can be used to calculate $f$ and a corresponding value of S for the above described formation. The only information required to calculate values of S and $f$ for this embodiment are the partition coefficients, $K_i$, for each precursor, the total volume V of carrier fluid injected into the formation, and the volume of fluid $V_i$ produced from the formation prior to detection of the maximal concentration of tracers.

Table II lists the calculated values of S and f using the foregoing Equations.

TABLE II

| Precursor | K | S | f |
|---|---|---|---|
| Methyl Acetate | 1.5 | .284 | .044 |
| Ethyl Acetate | 5.0 | .243 | .018 |
| Propyl Acetate | 8.0 | .217 | .007 |
| Butyl Acetate | 16.0 | .200 | 0 |

As can be seen from Table II the residual oil saturation that may be obtained by waterflooding the formation of the previous example is 20%.

Figure 2:
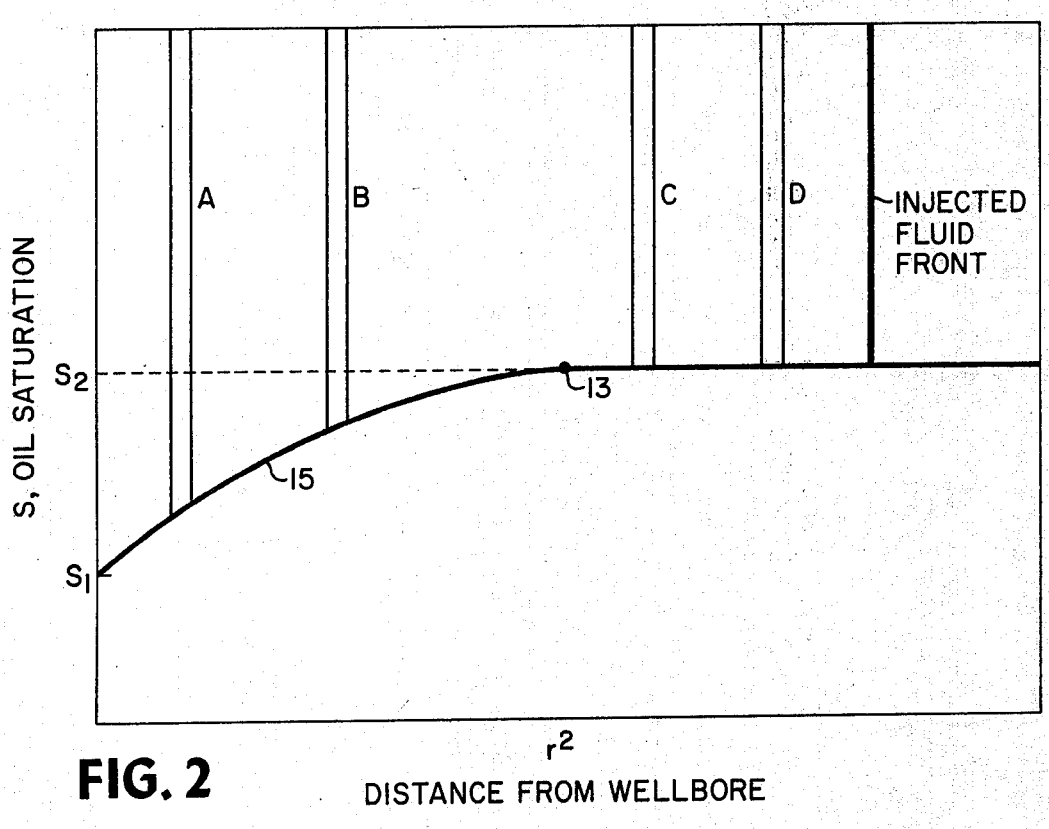
FIG. 2 is a plot of formation oil saturation as a function of distance from a wellbore showing the separation of precursors on passage of a carrier solution through the formation.

To more clearly illustrate the movement of the precursors through the formation containing mobile oil and water, reference is made to FIG. 2. This FIGURE shows the oil saturation in an oil-bearing formation as a function of the distance from the wellbore during the course of a typical test where a carrier fluid containing precursors is injected into an oil-bearing formation. A well which has been producing at a relatively constant oil/water ratio under a conventional waterflood operation would have a zone of relatively constant saturation $S_2$ corresponding to a producing fractional flow $f_2$ near the well. If brine containing precursors A, B, C, and D each having a different partition coefficient K were now injected into this well, a saturation-distance distribution 15 may be produced. After the passage of the carrier fluid front through the formation, relatively gradual displacement of oil can be obtained with continued passage of carrier fluid through the formation. Inflection point 13 on the saturation-distance curve represents the oil saturation $S_2$ just prior to start of injection.

The precursors move through the formation at different velocities because each has a different partition coefficient. Referring again to FIG. 2, it can be appreciated that there may be a precursor having a partition coefficient which will be designated herein as $K_2$ which will traverse the formation at the same rate as inflection point 13 to the saturation-distance curve. A precursor having a partition coefficient equal to or less than $K_2$ will traverse the formation with oil saturation $S_2$. For example, as shown in FIG. 2 precursors C and D will traverse the formation at different velocities; however, these precursor slugs will follow only oil saturation $S_2$. It follows therefore that in analyzing the results according to the method previously given, if two or more precursors give the same fractional flow and saturation and the fractional flow is greater than zero, it is known that oil saturation $S_2$ has been measured. Another procedure for determining $S_2$ is to measure $f_2$ before testing the formation and thereafter to measure $f$ as a function of S by practicing this invention. The value of $S_2$ can be determined from the saturation which corresponds to the tested value of $f_2$.

A tracer having a partition coefficient greater than $K_2$ will traverse the formation at the same rate as a particular point of constant oil saturation between $S_1$ and $S_2$.

It may be helpful in understanding the results of this invention to discuss the oil saturations that precursors can theoretically follow when a carrier fluid/precursor solution is injected into a formation containing mobile oil. The residual oil saturation can be measured by the practice of this invention in formations containing any degree of mobile oil saturation. The maximum oil saturation that the precursors can measure under the preferred embodiment of this invention may vary depending upon whether the carrier fluid/precursor solution is injected into a formation at connate water saturations or into a formation which has already been waterflooded. This discussion will therefore be directed to the maximum oil saturation (shown as $S_2$ in FIG. 2) that can be measured in a formation which is at connate water saturation and in a formation which has been waterflooded. Since the relation between S and $f$ for a typical reservoir can be generally depicted by the curve shown in FIG. 1, reference to FIG. 1 will be made herein to graphically illustrate oil saturations that may be measured with precursors in an aqueous carrier fluid.

When a carrier fluid is injected into a formation at connate water saturation, the foregoing embodiment of this invention is capable of measuring f as a function of S for all oil saturations from $S_1$ to $S_3$ (see FIG. 1). Precursors having a K of infinity will follow residual oil saturation $S_1$. Precursors having a K of zero, according to Buckley-Leverett theory, will follow oil saturation $S_3$ through the formation. Precursors with intermediate values of K will follow oil saturations between $S_1$ and $S_3$.

The value of $S_3$ can be measured in the manner previously described by employing a precursor with $K = 0$. Given a $f - S$ curve as shown in FIG. 1, the value of S can also be graphically determined by drawing a line 17 from the point where $f$ is 1 and S is 100% to a point of tangency 18 to the $f - S$ curve. The point of tangency, 18, represents the maximum oil saturation $S_3$ which can be followed by a precursor in an aqueous carrier fluid.

In a formation which has been waterflooded prior to injection of an aqueous carrier fluid containing precursors, the foregoing embodiment is capable of measuring f as a function of S for all oil saturations from $S_1$ to $S_2$ with $S_2$ being defined as the average oil saturation in the waterflooded formation near the injection well. According to Buckley-Leverett, $S_2$ may be slightly greater than $S_3$ when the formation is initially flooded. However, in that instance, the precursors will follow only oil saturations up to $S_3$ since $S_3$ is the maximum oil saturation that a precursor can follow. However, since it is very unlikely that $S_2$ will be greater than $S_3$ in a typical waterflooded formation, it can be assumed herein that $S_2$ is less than $S_3$. Since $S_2$ will most likely be less than $S_3$, some precursors having a K greater than zero will also follow oil saturation $S_2$.

As previously discussed, after the precursors have partially reacted to form a tracer, the fluids are drawn back to the formation through the injection well. These unreacted precursors tend to arrive at the production well simultaneously because of a mirror image effect. The tracer products of these precursors, however, arrive at the producing well at distinctly different times. As previously mentioned, the tracers each have a partition coefficient which is essentially zero. All of the tracers, therefore, traverse the formation at essentially the same velocity as the fluid being produced from the formation but they arrive at the producing well at different times because they are produced at different locations in the formation. Thus, the mirror image effect for the tracers is avoided and this difference in arrival times can be used to measure $f$ as a function of S. Although the tracers in the foregoing example had a partition coefficient of zero, it is not necessary to the practice of this invention that these tracers have a K of zero nor is it necessary that the tracers have the same K. If the precursors are soluble in both the carrier fluid and the crude oil, analysis of the results may be more complex. However, such analysis can be made by those skilled in the art. For the sake of brevity further discussion of the tracer movement back to the producing well according to fluid flow theory is not deemed necessary since those skilled in the art are familiar with such theories.

In the example previously given, each precursor was partially hydrolyzed to produce a tracer, i.e., alcohol, under nearly neutral conditions. The hydrolysis of ethyl acetate, for example, can be represented by:

$$CH_3COOC_2H_5 + H_2O \rightarrow CH_3COOH + C_2H_5OH \qquad \text{Equation 5}$$

The hydrolysis reaction can vary depending upon reservoir conditions, for example, high temperature, high acidity, or basicity will increase the reaction rate. Also, under strongly alkaline conditions the salt of carboxylic acid will be formed rather than the acidic product. Nevertheless, the alcohol will always be a reaction product and, where the process is properly controlled, some unreacted ester will be present. Where reservoir conditions are such that too little alcohol would be present in the produced fluids under desired operating conditions, the injected fluids can be buffered to a pH level which will result in measurable and distinguishable quantities of the alcohols.

Where the reaction rate is relatively slow and the injection-production period is relatively short compared to the soak period, the reaction occurring during the injection and production cycles can be ignored. Under these circumstances it can be assumed that the hydrolysis occurs only during the soak period. However, the reaction rates for the hydrolysis can be readily determined by simple laboratory analysis and results corrected accordingly if such a refinement is necessary.

The foregoing discusses one embodiment of the present invention. As indicated, the relation between fractional flow and oil saturation can be measured for all saturations from residual oil saturation, $S_1$, to oil saturation, $S_3$, (see FIG. 1). One skilled in the art, however, can readily appreciate that the relation between fractional flow and saturation of oil can be determined in the practice of this invention by employing a carrier fluid comprising a petroleum product instead of an aqueous solution. When oil is used as the carrier fluid the fractional flow of oil as a function of fluid saturation can be determined for all oil saturations from initial formation oil saturation $S_5$ to oil saturation $S_4$. Oil saturation $S_4$ is determined by laying a line 16 from the point where the saturation and fractional flow of oil are zero to the point of tangency 14 to the curve as shown in FIG. 1. The relation between fractional flow and saturation of oil could be determined in the manner previously discussed. The portion of the curve between oil saturation $S_3$ and $S_4$ can be determined by employing a carrier fluid comprising two fluid phases. The carrier fluid would be injected at known rates and the method as previously described can be used to determine the oil saturation for the known fractional flow. The fractional flow can be changed to determine a different saturation. By repeating these steps the relation between fractional flow and saturation between oil saturation $S_3$ and oil saturation $S_4$ can be determined. Thus, it can be appreciated that in the practice of this invention the relation between fractional flow and saturation of oil can be determined for all oil saturations from oil saturation, $S_5$, to residual oil saturation $S_1$ (See FIG. 1).

It should be clear from the foregoing that it is important in the practice of this invention that the precursors have differing partition coefficients between the carrier fluid and the oil phase and that each precursor and its corresponding tracer have different partition coefficients between the carrier fluid and the oil phase. Obviously, if the difference between the partition coefficients of the precursors is small, then in the practice of this invention, only a small segment of the curve in FIG. 1 could be determined. If two precursors have the same partition coefficient, theoretically only one point on the curve could be determined. Clearly, in order to determine the relation between fractional flow and saturation for a wide range of saturations, it is preferred to have a wide range of partition coefficients for the precursors.

The precursors and tracers produced from the precursors should both be soluble in the carrier fluid. Moreover, the tracers should be sufficiently soluble that their concentration in the carrier fluid will be enough that their presence can be detected when the carrier fluid is produced from the formation. In determining the concentrations of precursor to be employed, the effects of dispersion and diffusion should be considered as well as sensitivity of the detection means. When the carrier fluid is a liquid, the precursor or tracers may be liquid, dissolved solids, dissolved gases, or combinations. Precursors or tracers which will interact with or be strongly adsorbed by the formation rock, of course, should not be employed in the practice of this invention.

The precursors employed in the prior example were esters which would undergo a hydrolysis in the formation to produce an alcohol having a differing partition coefficient from the ester. It should be understood, however, that the practice of this invention is not limited to these specific esters or even the specific reaction indicated. Many precursors will undergo a change to produce at least one tracer product which has a partition coefficient between the carrier fluid and the crude oil which differs from the partition coefficient of its precursor. Routine laboratory analysis can be used to determine the suitability of such precursors in the practice of this invention.

The partition coefficients used in the chromatographic analysis are ratios which describe the equilibrium distribution of a substance between phases. These ratios are also known as distribution coefficients and equilibrium ratios and can be determined by simple experimental procedures. Where only two phases exist in the reservoir, as in the prior example, a two-phase partition coefficient is determined for each precursor. Known quantities of the carrier fluid, the crude oil, and the precursor are combined and vigorously agitated to insure complete and uniform mixing of the three components. After the system has reached equilibrium at reservoir conditions and the two fluid phases have segregated, the concentration of the precursor in each of the fluid phases is determined. The ratio of these concentrations is the partition coefficient for that precursor in that fluid system. A more detailed description of one method for determining partition coefficients is given in an article by Raimondi and Torcaso, "Mass Transfer Between Phases in a Porous Medium: A Study in Equilibrium," Society of Petroleum Engineers Journal, March 1965, page 51.

The produced fluids can be analyzed for the presence of tracer chemicals in any convenient manner. Conventional chemical analytical techniques can be employed to determine the presence and concentrations of tracers. Whenever radioactive isotopes are employed, conventional radiological detectors can be used. The volume of the precursor chemical bank should be great enough that the trace chemical is not highly dispersed in the formation prior to its production. However, the carrier fluid-precursor volume should not be so great that the chemical cost becomes prohibitive or that the length of time for producing the tracers is excessive.

In another embodiment of this invention a carrier fluid containing a plurality of chemical substances is injected into a subterranean formation containing mobile crude oil and water. The carrier fluid is substantially insoluble in the crude oil and soluble with the formation water. Preferably, these chemical substances are nonreactive in the formation. Each of the chemical substances has a distinct partition coefficient between the carrier fluid and the crude oil which differs from the partition coefficient of the other chemical substances. Because of this partition coefficient difference the chemical substances traverse the formation at different velocities. By detecting the presence of the chemical substances at another location in the formation, preferably at a producing well, and analyzing the results by previously discussed chromatographic techniques, the fractional flow and corresponding saturation of the formation crude oil and water can be determined.

It will be apparent from this disclosure that the method of this invention has broad applicability. The method may be employed to determine the saturation of oil in a hydrocarbon-bearing formation. The method may be employed to determine the residual oil saturation in a waterflooded formation prior to tertiary oil recovery operations. The method may be employed to determine the fractional flow of oil in the formation as a function of oil saturation. The method may be used to determine the water-oil flow properties of reservoir rocks to provide an estimate of the oil recovery that might be obtained by flushing a unit volume of the reservoir with water. The method may employ a single well for both injection and production or the method may employ two wells in the formation, one for injection and one for production. These oil saturations and flow properties can be determined when the well is initially completed or after the well is producing.

The principle of this invention and the best mode in which it is contemplated to apply that principle have been described. It is to be understood that the foregoing is illustrative only and that other means and techniques can be employed without departing from the true scope of the invention as defined in the following claims.

What I claim is:

1. A method for determining the fractional flow and corresponding saturation of fluid phases within a subterranean reservoir formation containing a first mobile fluid phase and a second mobile fluid phase which comprises injecting into the formation a carrier fluid containing a plurality of precursors having different partition coefficient between the carrier fluid and the first fluid phase, the carrier fluid being substantially insoluble in the first fluid phase and soluble with the second fluid phase, each of said precursors being capable of forming within the formation at least one tracer having a partition coefficient between the carrier fluid and the first fluid phase which differs from the partition coefficient of its corresponding precursor, permitting said precursors to react within the formation to obtain at least one tracer for each of said precursors, displacing said tracers through the formation, detecting said tracers following such displacement, and determining the fractional flow and corresponding saturation of the fluid phases in the formation by applying principles of chromatography as applied to two phase fluid flow in a porous medium.

2. A method as defined by claim 1 wherein the carrier fluid is a liquid.

3. A method as defined by claim 2 wherein the carrier fluid is aqueous.

4. A method as defined by claim 1 wherein said precursors are hydrolyzable esters.

5. A method as defined by claim 4 wherein the precursors are esters and the tracers are alcohols formed by hydrolysis of the esters.

6. A method as defined by claim 5 wherein the precursors are ethyl acetate, methyl acetate, propyl acetate and butyl acetate.

7. A method as defined by claim 6 where the tracers are methyl alcohol, ethyl alcohol, propyl alcohol and butyl alcohol.

8. A method as defined by claim 1 wherein the carrier fluid-precursor solution is injected at a location in a well and withdrawn from the same well.

9. A method as defined by claim 1 wherein the carrier fluid is a hydrocarbon.

10. A method as defined by claim 9 wherein the carrier fluid is oil.

11. A method as defined by claim 1 wherein the carrier fluid-precursor solution is injected into the formation at one well and is withdrawn from the formation at a second well which is spaced from the first well.

12. A method of determining the fractional flow and a corresponding saturation of crude oil in a subterranean oil-bearing formation containing mobile crude oil and mobile formation water which comprises injecting into the formation by means of a well an aqueous solution containing a plurality of precursors, each of said precursors having a different partition coefficient between the aqueous solution and the crude oil, said aqueous solution being soluble with the formation water and substantially insoluble in the crude oil, each of said precursors being capable of forming within the formation at least one tracer having a different partition coefficient than the partition coefficient of its respective precursor between the aqueous solution and the crude oil, the concentration of each precursor and reactivity of each precursor being sufficiently great to enable detection of said tracers, permitting the solution to remain in the formation until detectable quantities of tracers have been formed, withdrawing the solution containing tracers back to the well, detecting the presence of said tracers in the withdrawn solution, determining the fractional flow and corresponding saturation of the crude oil in the formation by applying principles of chromatography as applied to two phase fluid flow in a porous medium.

13. A method for determining the saturation of a first mobile fluid phase within a subterranean reservoir formation containing a second mobile fluid phase which comprises:

injecting into the formation a carrier fluid containing a plurality of precursors having a different partition coefficient between the carrier fluid and the first fluid phase, the carrier fluid being substantially insoluble in the first fluid phase and soluble with the second fluid phase, each of said precursors being capable of forming within the formation at least one tracer having a different partition coefficient than the partition coefficient of its respective precursor between the carrier fluid and the first fluid phase, the concentration of each of the precursors in the carrier fluid and the reactivity of each of the precursors being sufficiently great to enable detection of said tracers, permitting said precursors to react within the formation to obtain at least one tracer for each of said precursors, displacing said tracers through the formation, detecting said tracers following such displacement, and determining the saturation of said first fluid phase within the formation by using principles of chromatography as applied to two phase fluid flow in a porous medium.

14. A method for determining the fractional flow and corresponding saturation of a first mobile fluid phase in a subterranean formation containing a second mobile fluid phase which comprises injecting into the formation at a first location a carrier fluid which is substantially insoluble in the first fluid phase and soluble with the second fluid phase, incorporating in the carrier fluid a plurality of chemical tracer substances which have different partition coefficients between the carrier fluid and the first fluid phase, the concentration of each tracer being sufficient to enable its detection at a second location in the formation, displacing the carrier fluid and chemical substances to the second location in detectable quantities, detecting the tracers at the second location, and determining the fractional flow and corresponding saturation of the first mobile fluid phase in the formation by applying principles of chromatography as applied to two phase fluid flow in a porous medium.

15. A method as defined in claim 14 wherein the first mobile fluid phase is crude oil.

16. A method as defined in claim 14 wherein the second mobile fluid phase is formation water.

* * * * *